US005970518A

United States Patent [19]

Jordan

[11] Patent Number: 5,970,518

[45] Date of Patent: Oct. 26, 1999

[54] MULTIPLE PERSON OUTFIT

[76] Inventor: Aurellius M. Jordan, 620 Iris Ave., #128, Sunnyvale, Calif. 94086

[21] Appl. No.: 09/252,081

[22] Filed: Feb. 18, 1999

Related U.S. Application Data

[60] Provisional application No. 60/077,598, Mar. 9, 1998.

[51] Int. Cl.[6] ..... A41B 1/00

[52] U.S. Cl. ..... 2/69; 2/79; 2/115; 2/171

[58] Field of Search ..... 2/69, 79, 115, 2/227, 171

[56] References Cited

U.S. PATENT DOCUMENTS 3,599,240 8/1971 Shaper .
3,920,239 11/1975 White .
4,089,067 5/1978 Velasco ..... 2/69
4,535,479 8/1985 Paula ..... 2/115
4,722,098 2/1988 Stapleton .
4,773,102 9/1988 Curtis et al. ..... 2/69

*Primary Examiner*—Diana L. Oleksa
*Attorney, Agent, or Firm*—Patent & Trademark Services; Joseph H. McGlynn

[57] ABSTRACT

A outfit/costume that two or more people will wear at the same time. The outfit/costume has what appears from the outside to be three or more legs and the center leg will hold a leg of each person. It also has two arm sleeves, one for each person, inner sleeves that will hold the other two inner arms of the persons and at least two neck apertures for the persons wearing the outfit/costume.

6 Claims, 2 Drawing Sheets

FIG. 1
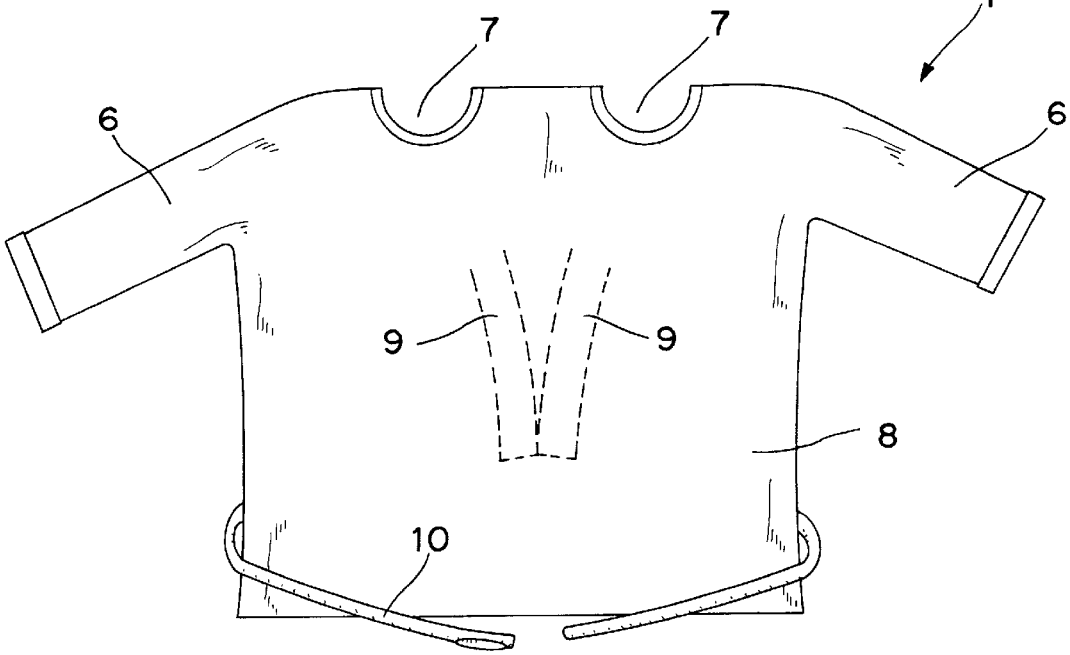
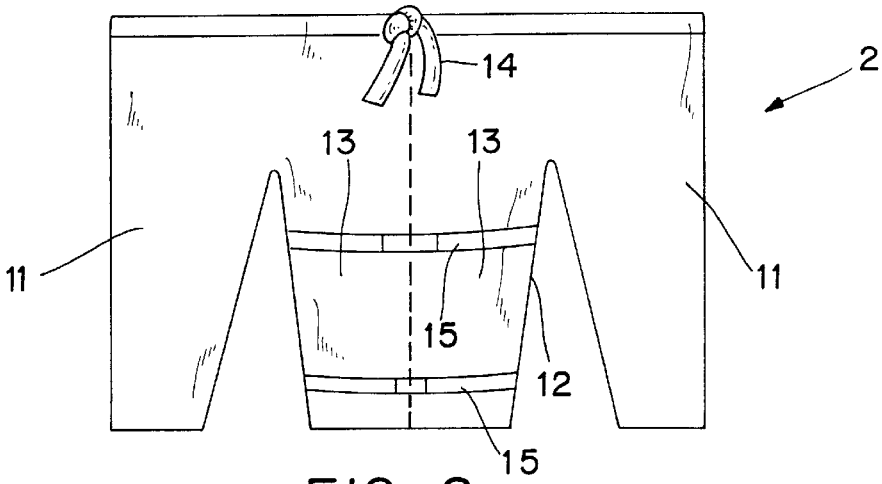
FIG. 2
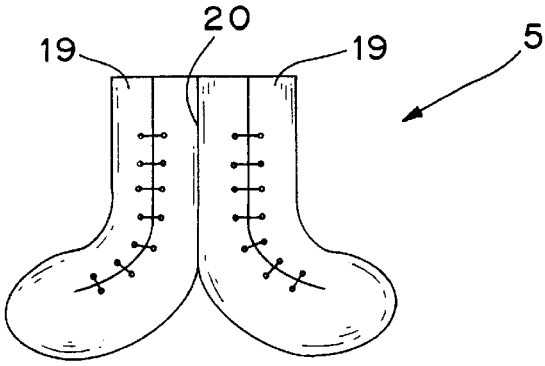
FIG. 7

MULTIPLE PERSON OUTFIT

This is a conversion of Provisional application 60/077,598, filed Mar. 9, 1998.

BACKGROUND OF THE INVENTION

This invention relates, in general, to wearing apparel, and, in particular, to a novelty outfit/costume.

DESCRIPTION OF THE PRIOR ART

In the prior art various types of outfit/costumes have been proposed. For example, U.S. Pat. No. 4,722,098 to Stapleton discloses a outfit/costume that gives the appearance that the wearer is being carried by a human or animal.

U.S. Pat. No. 3,599,240 to Shaper discloses a costume made from a sack and having a design thereon.

U.S. Pat. No. 3,920,239 to White discloses a costume that makes the wearer appear to be riding a horse.

SUMMARY OF THE INVENTION

The present invention is directed to a outfit/costume that two or more people will wear at the same time. The outfit/costume has what appears from the outside to be three legs and the center leg will hold a leg of each of the two persons. It also has two outer arms, one for each person and has two inner sleeves that will hold the other two arms of the persons wearing the outfit/costume. These inner arm sleeves are attached to the inner lining of the outfit/costume. These sleeves may be long or even short enough to be consider loops.

It is an object of the present invention to provide a new wearing apparel outfit/costume that brings two or more people in an effort to teach cooperation through fun and dedication.

It is also an object of the present invention to provide a new wearing apparel that gives the illusion that the people wearing the apparel have more than one head and more than two legs.

These and other objects and advantages of the present invention will be fully apparent from the following description, when taken in connection with the annexed drawings.

BRIEF DESCRIPTION OF THE DRAWINGS

FIG. 1 is a front view of the shirt of the present invention.

FIG. 2 is a front view of the pants of the present invention.

FIG. 7 is a front view of a shoe that can be worn with the present invention.

DESCRIPTION OF THE PREFERRED EMBODIMENT

Figure 3:
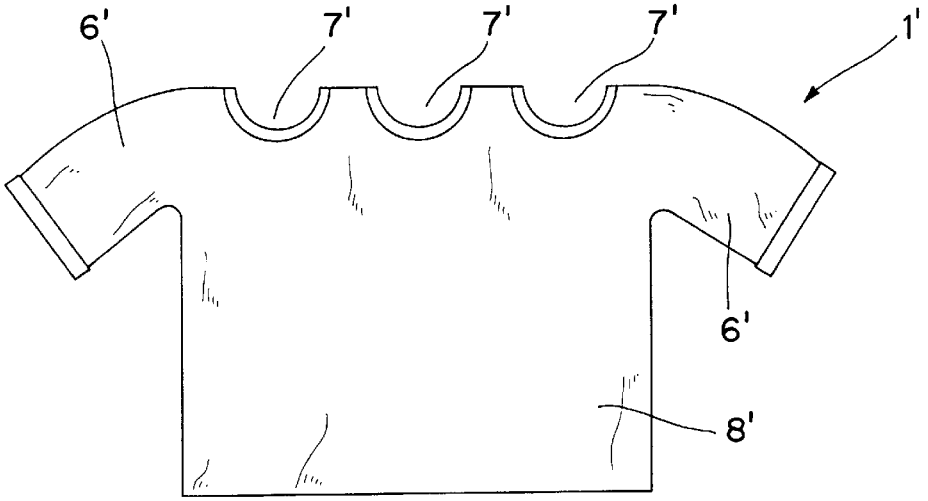
FIG. 3 is a front view of the shirt of a second embodiment of the present invention.

Referring now to the drawings in greater detail, FIG. 1 shows the shirt 1 of the present invention, which has a pair of sleeves 6, neck or head openings 7, and a body portion 8. The shirt also has a belt 10 attached thereto which will keep the shirt snug around the torsos of the persons wearing the shirt. Internally, near the center of the shirt are two sleeves 9 which will be used to hold the inner arms of the people using the shirt. The shirt can be made from any conventional fabric, using conventional sewing techniques.

In use, two people will wear the shirt 1 with person number 1's right arm extending through one of the sleeves 6 and person number 1's left arm inserted into one of the internal sleeves 9 or left uncontained if chosen. A second person will also be inside the shirt 1 with the second person's left arm extending through one of the sleeves 6 and the second person's right arm inserted into one of the internal sleeves 9 or left uncontained if chosen. In this manner the people wearing the shirt will appear to have two heads and only two arms.

FIG. 2 shows the pants 2 which can be worn by the same people wearing the shirt of FIG. 1. The pants 2 will have three legs, two legs 11 toward the outside of the pants, and one leg 12 positioned toward the center of the pants. The center leg 12 could be divided internally for two legs 13. The pants will have a conventional draw string 14, similar to the draw string on sweat pants to hold the pants on the wearers. It should be noted that the draw strings are merely for illustrational purposes and other types of securing means such as, but not limited to, belts and suspenders could be used.

In addition, belts 15 could be used around the center leg 12 to keep the legs inserted into the two internal legs 13 together as the wearers of the pants move around.

In use a first person's left leg will extend through one of the pants legs 11 and the person's right leg inserted into one of the internal legs 13. A second person's right leg will extend through the other of the pants legs 11 and that person's left leg will be inserted into the other of the internal legs 13. In this manner the people wearing the pants will appear to have three legs.

Figure 4:
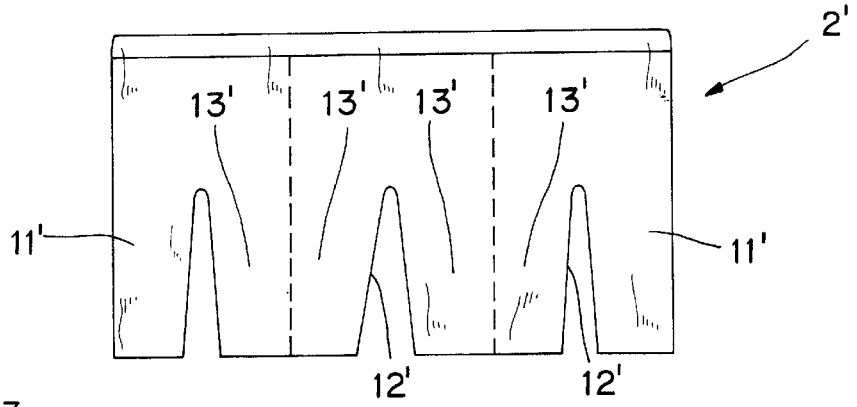
FIG. 4 is a front view of the pants of a second embodiment of the present invention.

Another embodiment of the shirt and pants are shown in FIGS. 3 and 4. In this embodiment the shirt and pants are essentially the same as the FIGS. 1 and 2 embodiment except that three people will wear the apparel. In the FIG. 3 embodiment, the shirt 1' will have two sleeves 6' and three neck apertures 7' so it will appear that the person wearing the shirt will have three heads and two arms. Obviously other shirts could be made using the same technique to make it appear that the person in the shirt has any number of heads by increasing the number of neck or head openings 7'.

The embodiment of the pants 2' shown in FIG. 4 is designed to be worn along with the shirt of FIG. 3. The pants 2' have two outside legs 11' and two center legs 12'. Each of the two center legs 12' could be divided into two internal legs 13'. Therefore the persons wearing the pants will appear to have four legs. Again, as in the case of the shirt, additional pants legs can be provided without departing from the scope of the invention. Also, the draw string 14 and the belts 15 could be used with this embodiment of the pants.

Figure 5:
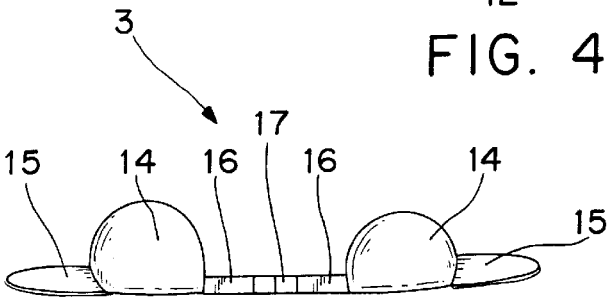
FIG. 5 is a side view of a hat that can be worn with the present invention.

The hat 3 shown in FIG. 5 could be worn by the people using the shirt 1 and/or the pants 2. The hats 14 are similar to the conventional baseball type cap, and have a bill 15 and will have conventional adjustments (not shown) which will allow the hats to fit any size of head. The caps 14 will have a strap 16 joining the two caps and a buckle 17 or other conventional adjustment means which can adjust the length of the straps 16. This will allow two people to wear the hats and allow for an adjustment based on the size of the people wearing the hats. The hats 14, strap 16, and buckle 17 are designed to align each individual's neck uniformly with the other.

Figure 6:
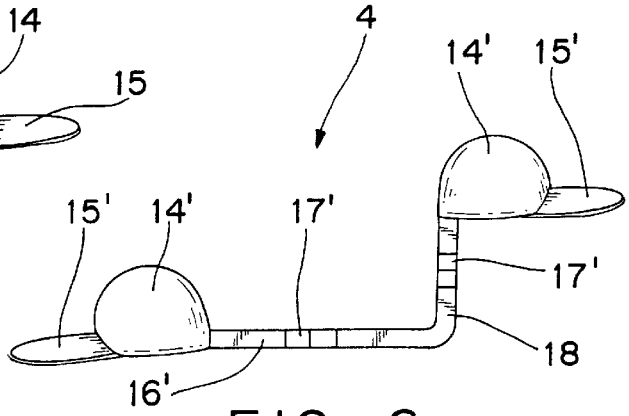
FIG. 6 is a side view of a second embodiment of a hat that can be worn with the present invention.

The embodiment of the hat 4 shown in FIG. 6 is similar to the embodiment shown in FIG. 5 except this hat also has an adjustment which will allow people of different heights to wear the hats. The hat 4 of FIG. 6 has a pair of caps 14', each of which has a bill 15'. An adjustment strap 16' having an adjusting buckle 17' is used to adjust the distance between the hats 14'. A second adjusting strap 18 having a buckle 17' will allow the relative heights of the two caps 14' to be adjusted also.

The shoe or sock 5 shown in FIG. 7 could also be worn with the outfit. The shoe or sock 5 could be a shoe and made from the same material as normal shoes such as, but not limited to, leather, or it could be a sock and made from the same material as athletic socks. The sock or shoe 5 would have an opening 19 at the top so that two feet could be inserted into the openings. The sock or shoe 5 would be joined at 20 so the feet in the sock or shoe 5 would be joined together. The sock or shoe 5 could be used by the wearer of the pants in FIG. 2 on the legs that are inserted into the center leg 12 and can be used by an individual competing against another individual by means of a hopping race and so forth.

The wearing apparel of the present invention could be used by two or more people at Halloween so they could go out trick and treating together. In addition the wearing apparel of the present invention could be used at picnics in a "three-leg" race or at any event where the theme is cooperation. However, it is to be noted that although this invention contains embodiments designed to work together, they fulfill the same purpose to a lesser degree separately, and it should be understood that the above uses are merely examples and should not be used to limit the uses of the present invention.

Although the Multiple Person Outfit and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A costume comprising:

a shirt and pants, said shirt having a body portion means for covering a person's upper torso, said body portion means having a pair of sleeves and a pair of means for allowing a person's head to pass through each of said pair of means, said body portion having an inner surface which will be directly adjacent a person's body when wearing said shirt, and an outer surface which will be remote from a person's body when wearing said shirt, an additional pair of sleeves, said additional pair of sleeves being attached to said inner surface, said pants having an opening in an upper portion thereof, and said pants having a first pair of legs attached thereto, said pants having a second pair of legs attached thereto, said second pair of legs being interposed between said first pair of legs.

2. The costume as claimed in claim 1, wherein said pants and shirt have means for securing them about a person's body.

3. The costume as claimed in claim 1, wherein said second pair of legs appears as a single leg from outside said pants, and wherein each of said second pair of legs have individual opening means for receiving a single leg on the inside of said pants.

4. The costume as claimed in claim 1, additionally including a pair of shoes, one of said pair of shoes appearing as two shoes.

5. The costume as claimed in claim 1, additionally including a pair of hats, said pair of hats being interconnected by a pair of straps, means for joining said straps.

6. The costume as claimed in claim 5, wherein said straps are joined at an angle that is less than 180 degrees.

* * * * *